US007828513B2

(12) United States Patent
Durocher et al.

(10) Patent No.: US 7,828,513 B2
(45) Date of Patent: Nov. 9, 2010

(54) AIR SEAL ARRANGEMENT FOR A GAS TURBINE ENGINE

(75) Inventors: Eric Durocher, Vercheres (CA); Rene Paquet, Montréal (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 966 days.

(21) Appl. No.: 11/538,863

(22) Filed: Oct. 5, 2006

(65) Prior Publication Data

US 2008/0085183 A1 Apr. 10, 2008

(51) Int. Cl.
*F01D 11/02* (2006.01)

(52) U.S. Cl. ..... 415/111

(58) Field of Classification Search ..... 415/111
See application file for complete search history.

(56) References Cited

U.S. PATENT DOCUMENTS

| | | | | |
|---|---|---|---|---|
| 3,844,110 | A * | 10/1974 | Widlansky et al. | 60/39.08 |
| 4,561,246 | A * | 12/1985 | Hovan | 60/226.1 |
| 6,513,335 | B2 * | 2/2003 | Fukutani | 60/785 |
| 6,629,816 | B2 * | 10/2003 | Langston et al. | 415/111 |
| 2003/0185669 | A1 * | 10/2003 | Brauer et al. | 415/111 |
| 2005/0111964 | A1 * | 5/2005 | Krammer et al. | 415/115 |

* cited by examiner

*Primary Examiner*—Edward Look
*Assistant Examiner*—Jesse Prager
(74) *Attorney, Agent, or Firm*—Ogilvy Renault LLP

(57) ABSTRACT

The air seal arrangement is for a disc wheel in a gas turbine engine. The disc wheel comprises a sleeve portion having an outer surface. The arrangement comprises a static knife edge seal in registry with the outer surface. The static knife edge seal has a free end adjacent to the outer surface.

10 Claims, 2 Drawing Sheets

AIR SEAL ARRANGEMENT FOR A GAS TURBINE ENGINE

TECHNICAL FIELD

The invention relates to an air seal arrangement, and in particular to an air seal arrangement for use within a gas turbine engine.

BACKGROUND

Various air seals are provided in gas turbine engines between rotating parts and non-rotating parts. Some air seals are used for maintaining gases within a pressurized area while others are used to regulate the flow of air from one area to another.

Overall, although existing air seal arrangements in gas turbine engines were generally satisfactory, there is always room for improvement.

SUMMARY

In one aspect, the present concept provides an air seal arrangement for a disc wheel in a gas turbine engine, the disc wheel comprising a sleeve portion having an outer surface, the arrangement comprising a static knife edge seal in registry with the outer surface, the static knife edge seal having a free end adjacent to the outer surface.

In another aspect, the present concept provides a disc wheel and static knife edge seal assembly mounted around a hollow shaft, a first air chamber adjacent to an exterior side of the shaft and an interior side of the disc wheel, a second air chamber adjacent to an exterior side of the disc wheel and an interior side of the static knife edge seal and a third air chamber adjacent to the exterior side of the disc wheel and an exterior side of the static knife edge seal, the first air chamber being in direct fluid communication with an interior portion of the hollow shaft, the second air chamber being in direct fluid communication with the first air chamber and the third air chamber being in direct fluid communication with the second air chamber, the fluid communication between the second and third chambers being made through an annular gap extending between the static knife edge seal and the exterior side of the disc wheel.

Further details of these and other aspects of the improved air seal arrangement will be apparent from the detailed description and figures included below.

BRIEF DESCRIPTION OF THE FIGURES

For a better understanding and to show more clearly how it may be carried into effect, reference will now be made by way of example to the accompanying figures, in which.

DETAILED DESCRIPTION

Figure 1:
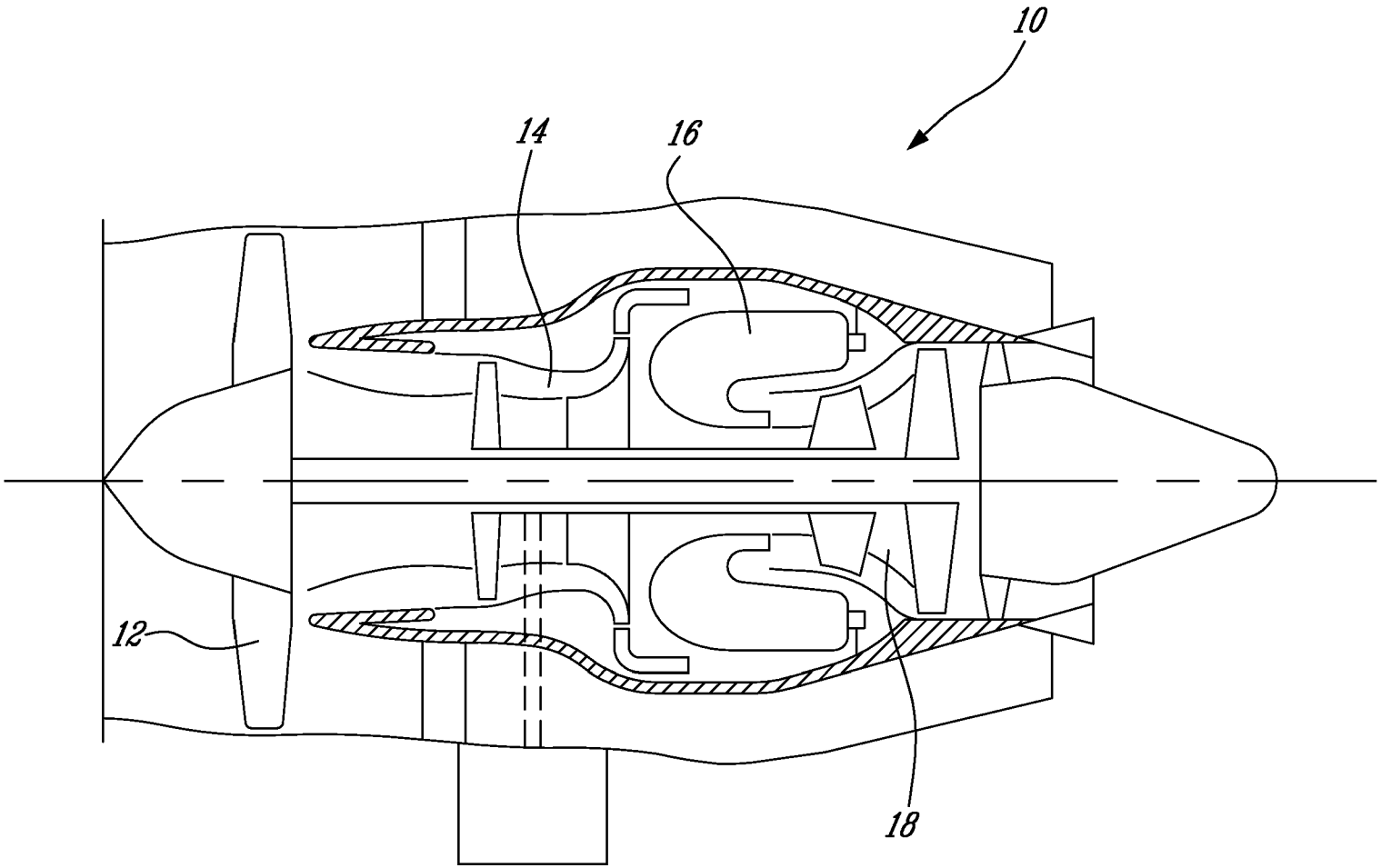
FIG. 1 schematically shows a generic turbofan gas turbine engine to illustrate an example of a general environment around which the improved air seal arrangement can be used.

FIG. 1 illustrates a turbofan gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. FIG. 1 only shows one example of the engine with which the improved air seal arrangement can be used. The improved air seal arrangement can also be used with other turbofan models or other kinds of gas turbine engines, such as turboprop and turboshaft engines.

Figure 2:
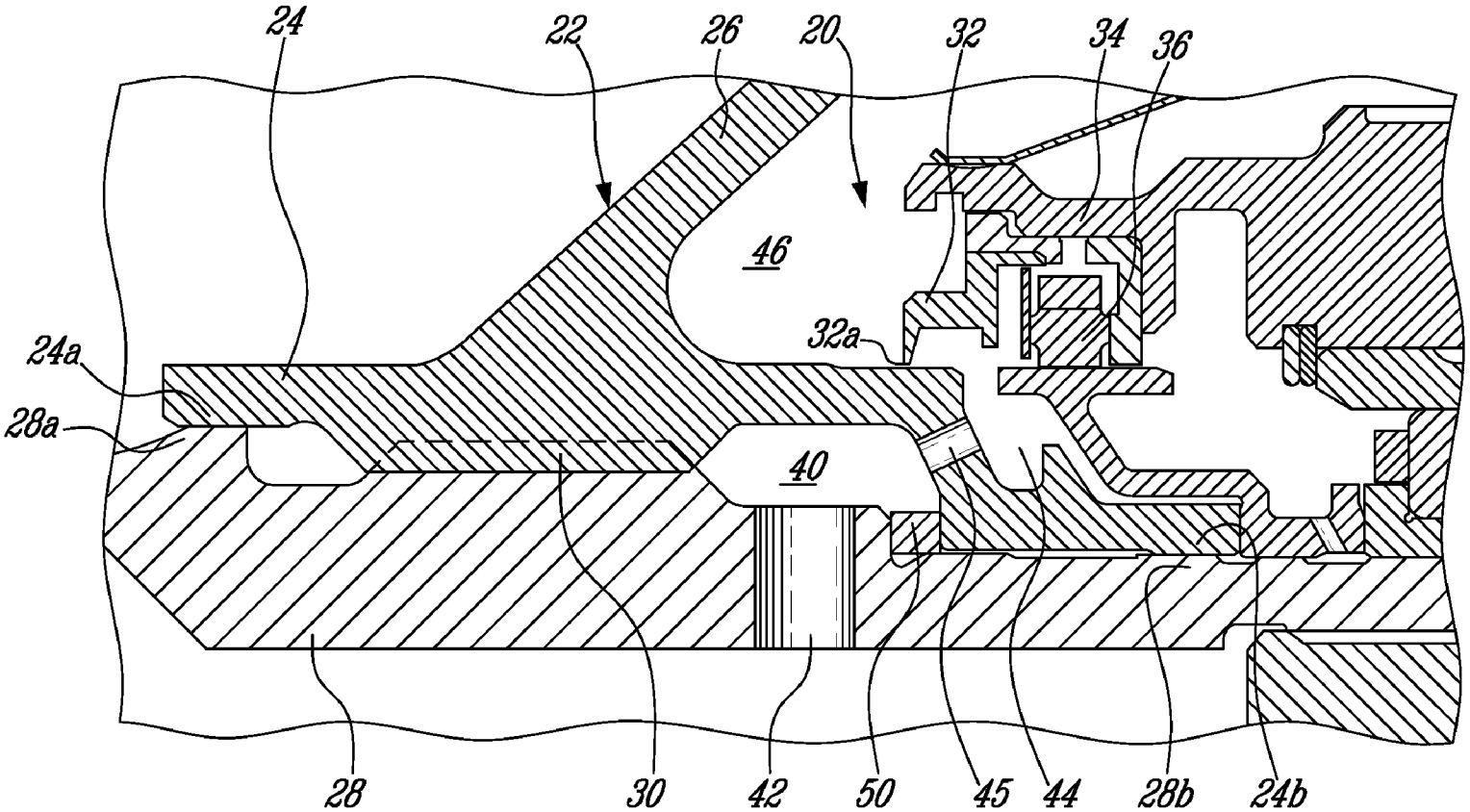
FIG. 2 is a side view of an example of a turbine disc around which an example of an air seal arrangement is provided.

Referring now to FIG. 2, there is shown an example of an air seal arrangement 20 for a turbine disc wheel 22 within a gas turbine engine. It should be noted that although a turbine disc wheel 22 is shown and described herein, the improved air seal arrangement 20 can also be used on a compressor disc wheel.

The disc wheel 22 comprises a sleeve portion 24 and web portion 26 integrally connected to the sleeve portion 24. The sleeve portion 24 is mounted around a shaft 28. The shaft 28 and the interior of the sleeve portion 24 are in rotational engagement, for instance using intermeshed parts 30. Opposite ends 24*a*, 24*b* of the sleeve portion 24 are also in an interfering engagement with corresponding portions 28*a*, 28*b* of the shaft 28. This connection, called spigot fit, prevents the disc wheel 22 from moving longitudinally.

In the improved air seal arrangement 20, the sleeve portion 24 is extended adjacent to a static knife edge seal 32. The static knife edge seal 32 is connected to a fixed structure 34. In FIG. 2, the static knife edge seal 32 is adjacent to one of the bearing 36 of the shaft 28. The static knife edge seal 32 is also in registry with the outer surface of the sleeve portion 24. It comprises a free end 32*a* that is adjacent to the surface.

In the illustrated embodiment, the air seal arrangement 20 is used to regulate the air flow coming from inside the shaft 28 to a chamber underneath the sleeve portion 24. A hole 42 in the shaft 28 creates an air path with the chamber 40. Air is sent to another chamber 44 in fluid communication with one side of the static knife edge seal 32 by mean of a hole 45. Pressurized air is allowed to flow between the free end 32*a* of the static knife edge seal 32 and the outer surface of the sleeve portion 24. Air flows radially outwards in a chamber 46 on a side of the disc wheel 22 for cooling purposes. This arrangement 20 provides a better air path from inside the shaft 28 and prevents air from escaping through the spigot fit. A seal 50 is provided within the air chamber 40 prevent air form escaping between the rearmost part of the sleeve portion 24 and the shaft 28. Also, the design of the sleeve portion 24 being longer, the disc wheel 22 has a better dynamic stability and generate less vibrations. In FIG. 2, the disc wheel base length, which corresponds to the distance between two spigot fits, is about 60% longer than prior designs for a similar engine.

Overall, the air seal arrangement 20 is improved and simplified. The assembly of the parts is also simplified.

The above description is meant to be exemplary only, and one skilled in the art will recognize that other changes may also be made to the embodiments described without departing from the scope of the invention disclosed as defined by the appended claims. For instance, the present invention is not limited to a turbine disc wheel and can also be used on a compressor disc wheel. It is also not limited to a wheel exactly as illustrated, nor a static knife edge seal exactly as illustrated. For instance, the outer surface of the sleeve portion can be inclined with reference to the central axis of the wheel or even be curved. It can also be shorter than what is shown. Still other modifications which fall within the scope of the present invention will be apparent to those skilled in the art, in light of a review of this disclosure, and such modifications are intended to fall within the appended claims.

What is claimed is:

1. An air seal arrangement for a disc wheel in a gas turbine engine, the disc wheel comprising a sleeve portion having an outer surface, the arrangement comprising a static knife edge seal in registry with the outer surface without contacting the outer surface, the static knife edge seal having a free end adjacent to the outer surface, the free end of the static knife edge seal and the outer surface of the sleeve portion of the disc wheel being spaced apart to regulate an air flow by allowing air to flow in a gap between the free end and the outer surface of the sleeve portion, the sleeve portion of the disc wheel comprising a recess defining a first chamber with a shaft on which the disc wheel is secured in rotational engagement, the sleeve portion having at least one passage between the first chamber and a second chamber defined between the outer surface of the sleeve portion and an interior side of the static knife edge seal, the first chamber and the second chamber separated by the sleeve portion.

2. The arrangement as defined in claim 1, wherein the disc wheel is connected to the shaft by a spigot fit.

3. The arrangement as defined in claim 1, wherein the disc wheel is a compressor disc.

4. The arrangement as defined in claim 1, wherein the disc wheel is a turbine disc.

5. A disc wheel and static knife edge seal assembly mounted around a hollow shaft such that the disc wheel is rotationally engaged with the shaft, a first air chamber adjacent to an exterior side of the shaft and an interior side of the disc wheel, a second air chamber adjacent to an exterior side of the disc wheel and an interior side of the static knife edge seal and a third air chamber adjacent to the exterior side of the disc wheel and an exterior side of the static knife edge seal, the first air chamber being in direct fluid communication with an interior portion of the hollow shaft, the second air chamber being in direct fluid communication with the first air chamber and the third air chamber being in direct fluid communication with the second air chamber, the fluid communication between the second and third chambers being made through an annular gap extending between a free end of the static knife edge seal and the exterior side of the disc wheel.

6. The assembly as defined in claim 5, wherein the interior side and the exterior side of the disc wheel are part of a substantially cylindrical projection of the disc wheel on one side of a web portion thereof.

7. The assembly as defined in claim 6, wherein the substantially cylindrical projection comprises a proximate subsection and a distal subsection relative to the web portion of the disc wheel, the distal subsection having an internal diameter larger than that of the proximate subsection.

8. The assembly as defined in claim 5, wherein the disc wheel is connected to the shalt by a spigot fit.

9. The assembly as defined in claim 5, wherein the disc wheel is a compressor disc.

10. The assembly as defined in claim 5, wherein the disc wheel is a turbine disc.

* * * * *